US010401075B2

(12) United States Patent
Bond

(10) Patent No.: US 10,401,075 B2
(45) Date of Patent: Sep. 3, 2019

(54) CHEST COOLER ACCESSORY

(71) Applicant: Glen W. Bond, Monroe, UT (US)

(72) Inventor: Glen W. Bond, Monroe, UT (US)

( * ) Notice: Subject to any disclaimer, the term of this patent is extended or adjusted under 35 U.S.C. 154(b) by 144 days.

(21) Appl. No.: 15/603,745

(22) Filed: May 24, 2017

(65) Prior Publication Data

US 2017/0251780 A1 Sep. 7, 2017

Related U.S. Application Data

(63) Continuation-in-part of application No. 14/185,478, filed on Feb. 20, 2014, now abandoned.

(51) Int. Cl.

| | |
|---|---|
| ***F25D 3/08*** | (2006.01) |
| ***B65D 25/04*** | (2006.01) |
| ***A45C 13/02*** | (2006.01) |
| ***B65D 25/10*** | (2006.01) |
| ***A45C 11/20*** | (2006.01) |

(52) U.S. Cl.

CPC ..... *F25D 3/08* (2013.01); *A45C 11/20* (2013.01); *A45C 13/02* (2013.01); *B65D 25/04* (2013.01); *B65D 25/10* (2013.01); *B65D 25/101* (2013.01); *A45C 2013/026* (2013.01); *F25D 2331/80* (2013.01); *F25D 2331/804* (2013.01); *F25D 2400/10* (2013.01)

(58) Field of Classification Search

CPC . A45C 11/20; A45C 13/20; F25D 3/08; F25D 2331/804; F25D 2331/80; B65D 25/04; B65D 25/10; B65D 25/101

USPC ... 220/522, 592.01–592.28, 500–557, 915.2, 220/915.1, 212, 521; 62/457.1–457.9, 62/465

See application file for complete search history.

(56) References Cited

U.S. PATENT DOCUMENTS

| | | | | |
|---|---|---|---|---|
| 5,181,555 | A * | 1/1993 | Chruniak | B60N 3/103 165/41 |
| 5,400,610 | A * | 3/1995 | Macedo | A45C 11/20 116/216 |
| 5,407,218 | A * | 4/1995 | Jackson | A45C 5/14 280/30 |
| 6,105,844 | A * | 8/2000 | Walters | A45C 11/20 206/541 |
| 6,209,346 | B1 * | 4/2001 | Frosch | A45F 3/46 62/457.7 |
| 6,315,149 | B1 * | 11/2001 | Conrado | A45C 5/14 220/521 |
| 2002/0095947 | A1 * | 7/2002 | Treppedi | A45C 11/20 62/457.9 |

(Continued)

*Primary Examiner* — Jeffrey R Allen
*Assistant Examiner* — Jennifer Castriotta
(74) *Attorney, Agent, or Firm* — M. Reid Russell

(57) ABSTRACT

A chest cooler accessory for maintaining food items above a level of ice and water within the chest cooler that includes a rectangular elastic net that is maintained around three sides to the undersurface of the chest cooler lid to be open along the rectangular elastic net side that is adjacent to the lid latching side to allow food items to be passed into the rectangular elastic net that flexes to support which items above the water and ice level during transport, and which rectangular elastic net attachment to the lid undersurface is with fasteners that do not effect the lid internal integrity, and said rectangular elastic net is arranged to have a splash guard mounted thereto to block passage of water therethrough.

6 Claims, 7 Drawing Sheets

(56) References Cited

U.S. PATENT DOCUMENTS

| | | | | |
|---|---|---|---|---|
| 2006/0065655 | A1* | 3/2006 | Taylor | A45C 7/0036<br>220/6 |
| 2006/0144077 | A1* | 7/2006 | Morris | F25D 3/08<br>62/459 |
| 2006/0201744 | A1* | 9/2006 | Curtis | A62B 1/22<br>182/138 |

* cited by examiner

CHEST COOLER ACCESSORY

This application is a Continuation in Part Application of application Ser. No. 14/939,947, for a "CHEST COOLER ACCESSORY" filed Nov. 12, 2015, that is abandoned with the entry of this Continuation in Part application.

BACKGROUND OF THE INVENTION

Field of the Invention

The invention relates to accessory items for inclusion with portable ice chest coolers as a person will carry with them in the wilderness, to a sporting event, or in a vehicle, where ice is poured into the cooler to keep items, such as drinks, cold and to chill food items, such as sandwiches, cheese, and the like. With the accessory item for maintaining such food items above the ice and water level, protecting them from water contamination.

Prior Art

Heretofore, where an owner has wished to carry both drinks and food items in their ice chest for a distance, or over time, they have attempted to separate such food items as by placing non-food items, such as trays, dishes or the like above the ice level with such food items there above, or have packed the food items in separate containers, or the like. In practice, where the chest has been exposed to movement during travel, as the ice melts, water has sloshed over the food items, making them undesirable for consumption. The invention, to protect such food items, employs an elastic net arrangement that is fixed to the undersurface of the ice chest lid, apart from the level of ice and water within the chest, for carrying the perishable food items above and away from the melting ice while still keeping those food items cool and dry. Additionally, recognizing that the ice chest, in a normal course of use, could fall onto its side or be dropped and cause water to splash onto the elastic net and onto the food items therein, the invention further includes a splash guard that is easily releasably installed to cover over the elastic net as a barrier to water reaching the food items. Which splash guard, by utilizing attachment points that are at spaced internals around the splash guard perimeter, such that, any water as reaches the food items, such water will travel out from between which attachment points and back into the water and ice mixture when the ice chest is righted.

SUMMARY OF THE INVENTION

It is a principal object of the present invention to provide an elastic net for mounting to the undersurface of a conventional ice chest cooler to maintain food items above the level of ice and water within the chest during transport and over time.

Another object of the present invention is to provide an elastic net arrangement mounted on three sides to the ice chest lid undersurface that has spaced holes formed therethrough to receive push to lock fasteners that are fitted through the elastic net and are press fitted into the holes formed in the undersurface of an ice chest cooler lid, securing the elastic net thereto, above a level of ice and water within the chest, for receiving food items passed across the open elastic net side and holding such food items above and out of the ice and water.

Still another object of the present invention is to provide an elastic net arrangement that is easily and permanently mounted to an undersurface of an ice chest cooler lid to receive and protect food items fitted therein from water damage during movement of the ice chest, where the installation of the elastic net will not effect the insulating characteristics of the chest lid.

The invention is an accessory item for a conventional ice chest cooler that is in an elastic net arranged for mounting to an undersurface of the chest lid and, ay include a flexible strap frame connected to three sides of the elastic net, where the elastic net receives press to lock fasteners installed at intervals around three sides of the elastic nets that are push fitted into holes formed through the chest lid undersurface to lock within the lid, with the unconnected side of the elastic net, adjacent to the lid latch edge, is left open to receive food items fitted there across and held place by the net, maintain the food items above a level of ice and water in the cooler. Additionally, the invention preferably includes a a splash guard for release able attachment across the elastic net to protect the food items from water contamination should the chest cooler be tipped and the water and ice therein splash into the elastic net, which splash guard is preferably attached at spaced points around the elastic net outer edges to provide gaps between which attachment point for water to drain back into the water and ice mixture.

BRIEF DESCRIPTION OF THE DRAWINGS

These and other objects and features of the present invention will become more apparent from the following description in which the invention is described in detail in conjunction with the accompanying drawings.

DETAILED DESCRIPTION

Figure 1:
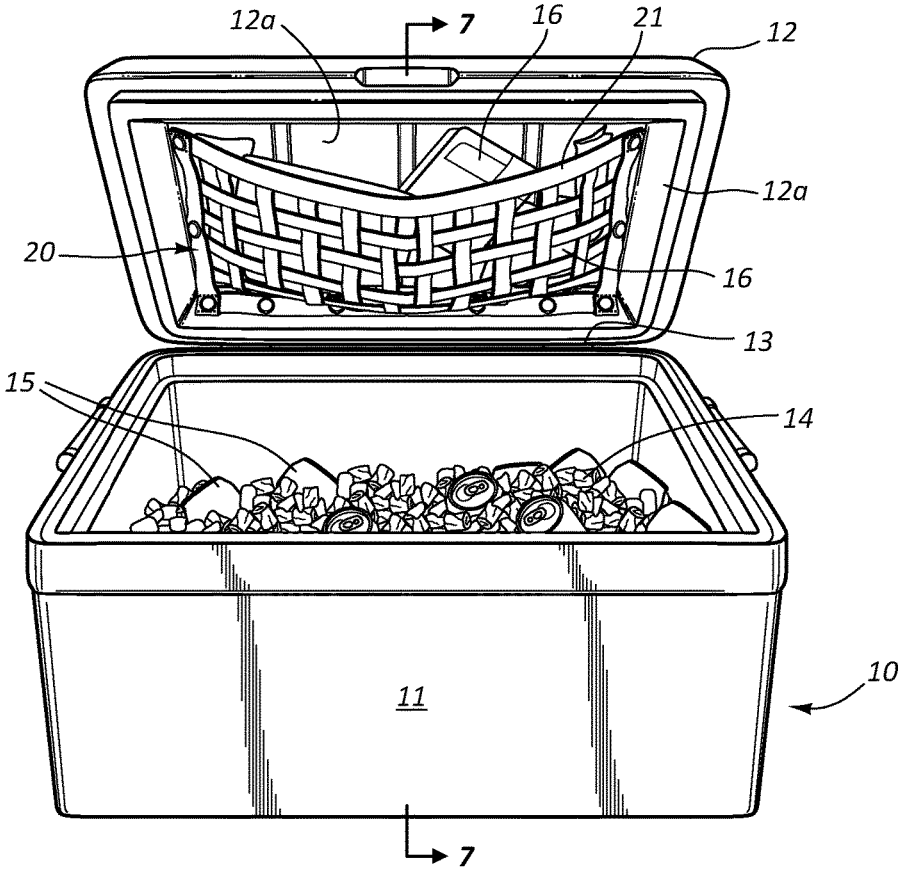
FIG. 1 is a front elevation perspective view of the invention in a chest cooler accessory where the chest cooler is shown as containing ice with canned drinks therein, and shows the chest lid as having been raised, exposing the chest cooler accessory that consists of an elastic strap net and flexible fabric frame mounted to the underside of the chest lid that is shown as containing food items.
Figure 7:
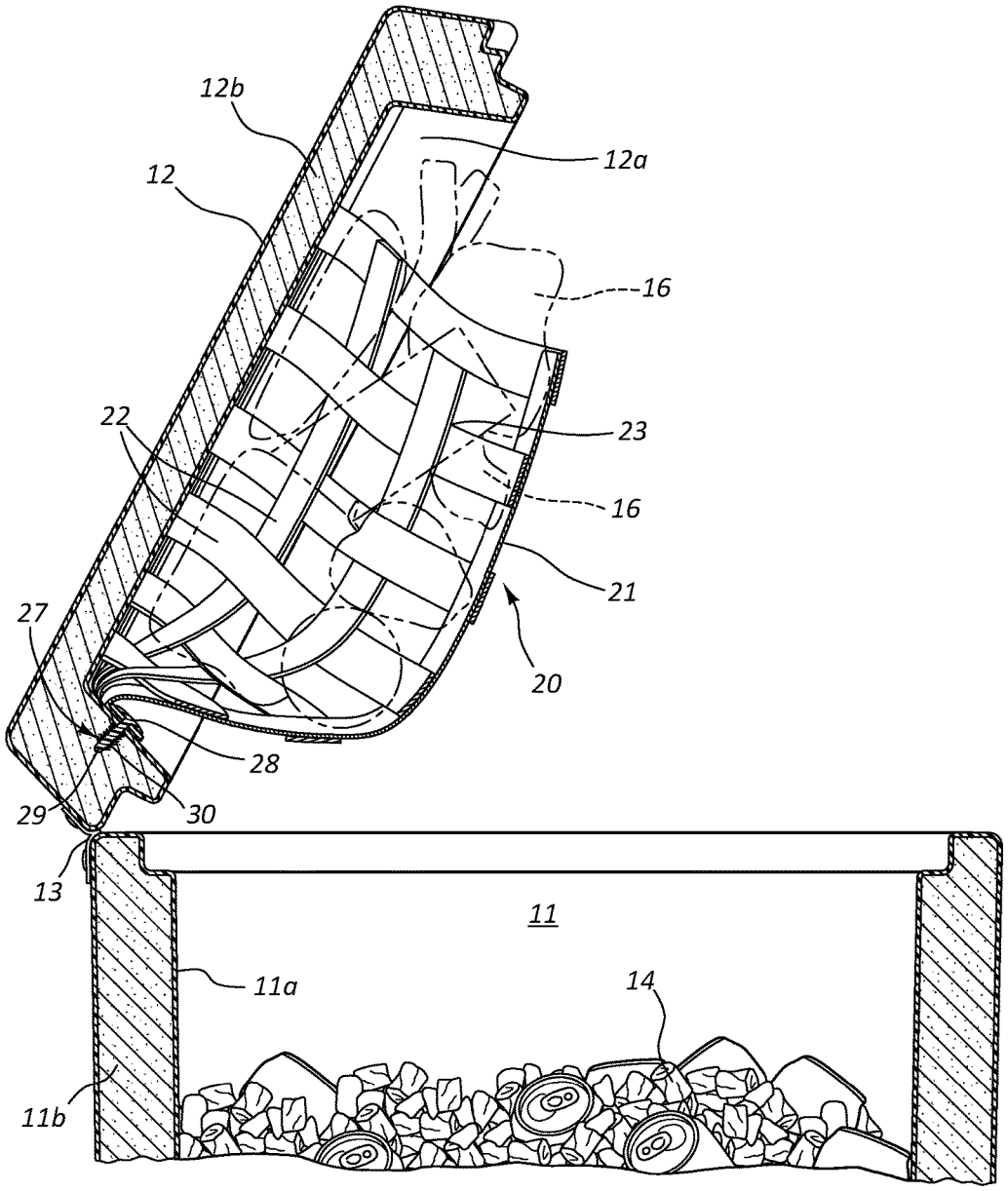
FIG. 7 is a side elevation sectional view of the top portion of the chest cooler and cooler lid showing the chest cooler as containing a level of ice and showing food items supported within the elastic strap net.
Figure 8:
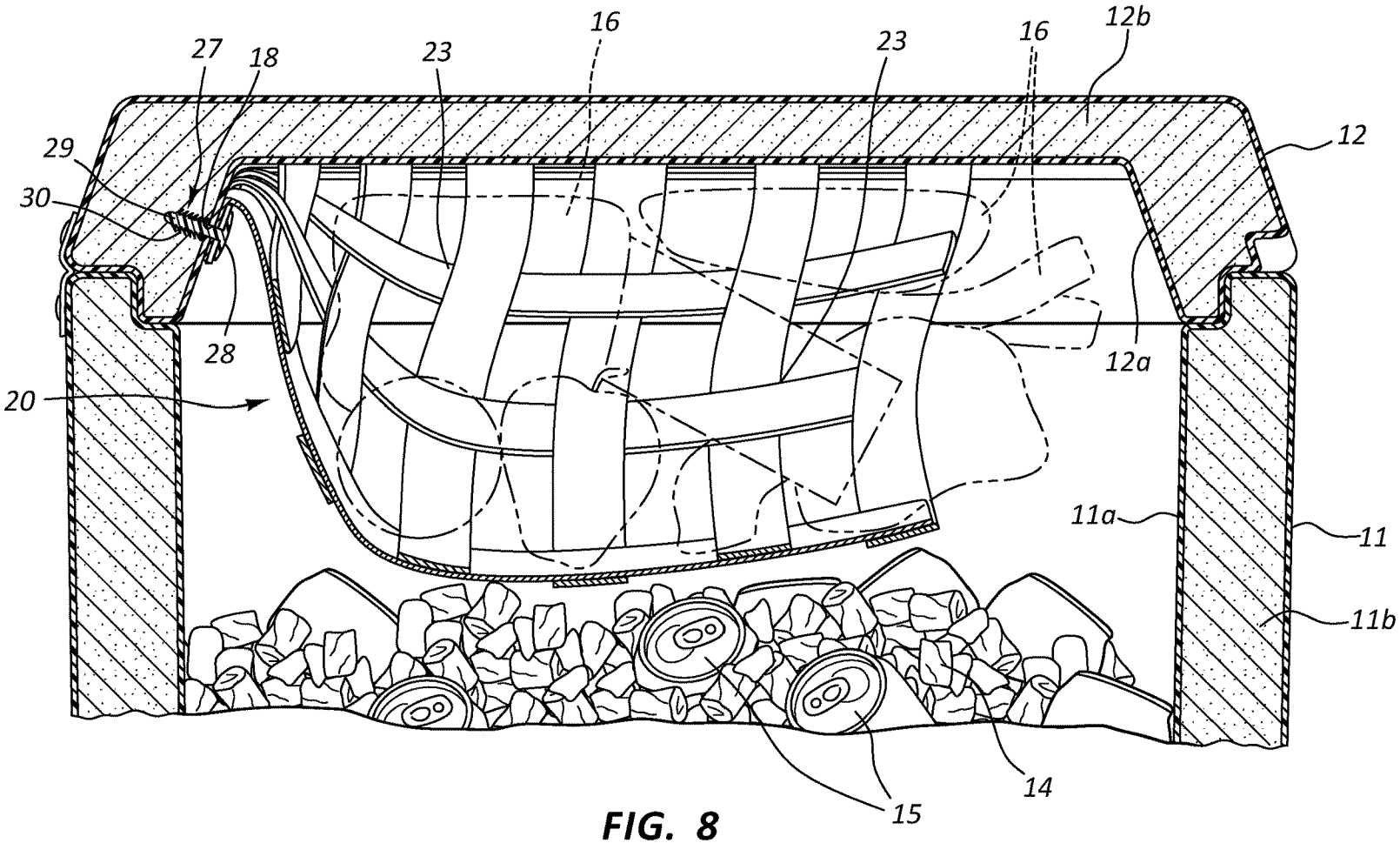
FIG. 8 is a front elevation sectional view of the top portion of the chest cooler and cooler lid, with the lid closed over the chest cooler top portion, showing the elastic net supported above the level of ice and water in the chest cooler.

The invention, as is hereinafter described, is in chest cooler accessory as shown in the Figs., with FIG. 1 showing a front elevation view of such chest cooler 10 that includes a rectangular box 11 with a lid 12 that is connected along hinge 13 that is pivoted to close over the open top of the rectangular box, as shown in FIG. 8. The rectangular box 11 includes an inner shell 11*a* for fitting into the box 11, and is spaced apart therefrom to provide an air space therebetween, or is arranged to receive an insulation material 11*c* installed therein, as shown in FIGS. 7 and 8. Which FIGS. 7 and 8 also show the lid 12 as including an inner lid 12*a* that is also spaced apart from the lid 12 to provide an air space therebetween, or which space can receive an insulation material 12*b* installed therein.

Shown in FIGS. 1, 7 and 8, the chest cooler 10 rectangular box 11 is filled with a layer of ice 14 that a number of canned drinks 15 are shown immersed in. Over time, and during travel, that ice will melt and turn to water that, of course, will not effect the containerized drinks 15 or food items that are maintained in their own containers. However, for perishable food items 16, such as wrapped sandwiches, cheese in plastic wraps or loose wraps, fruit, or the like, that, when exposed to the water and ice mixture, may become uneatable. Even when the perishable food items 16 are separated from the ice and water, they may be exposed or immersed when the chest cooler is moved or tilted.

The invention is in a chest cooler accessory to overcome the problem of separation of food items 16 from the ice and water mixture by providing a simple and effective elastic net arrangement secured to the lid 12 inner surface 12*a* to maintain such food items 16 above the level of ice and water 14. Shown in the Figs., the accessory for a chest cooler 10, is in a food item support 20 that in shown in FIG. 2 as including an elastic net 21 that is formed, in one embodiment, from elastic cloth straps 22 that cross at right angles, forming the rectangular elastic net 21, and in another embodiment of FIGS. 9 through 11 as a single elastic net 50. The elastic cloth straps 22 crossings 23 are preferably formed by weaving the straps over and under one another, as shown best in FIGS. 1, 7 and 8, and which crossings of the elastic cloth straps 22 are preferably secured together, as by sewing, or by application of an adhesive thereto, or the like. So arranged, the elastic net 21, and elastic net 50, will stretch to receive food items 16 fitted therein, supporting those food items, above the ice and water level, and will return to its unstretched attitude when the food items 16 are removed.

Figure 2:
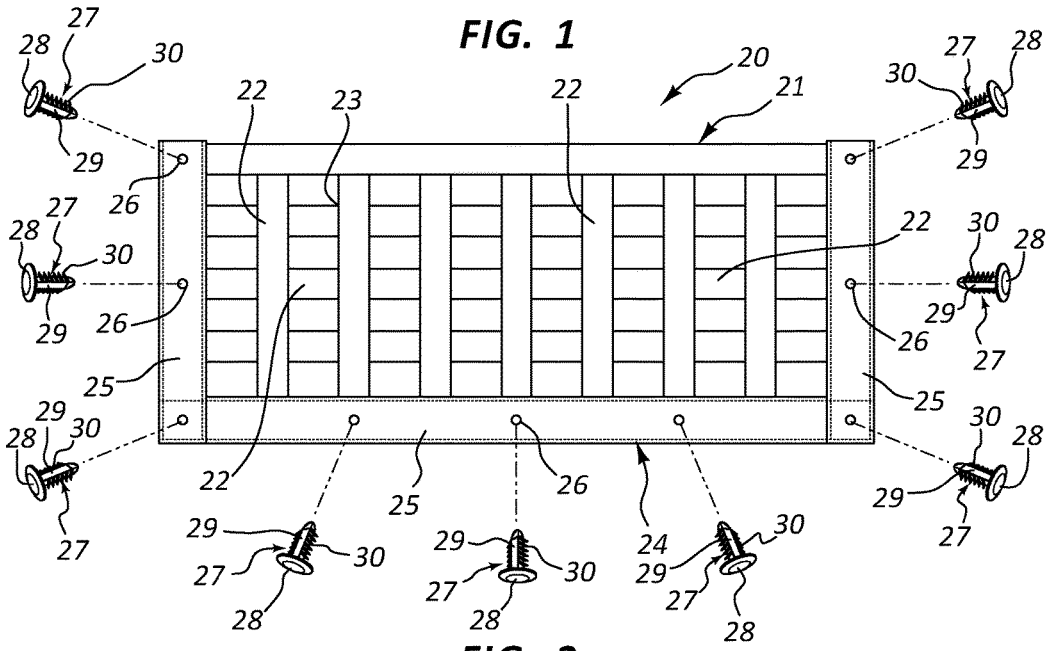
FIG. 2 is a front elevation view of the elastic strap net attached on three sides to the flexible fabric frame adjacent to the lid latch side of FIG. 1, and shows press to lock fasteners aligned with each of spaced holes formed through the flexible fabric frame.
Figure 9:
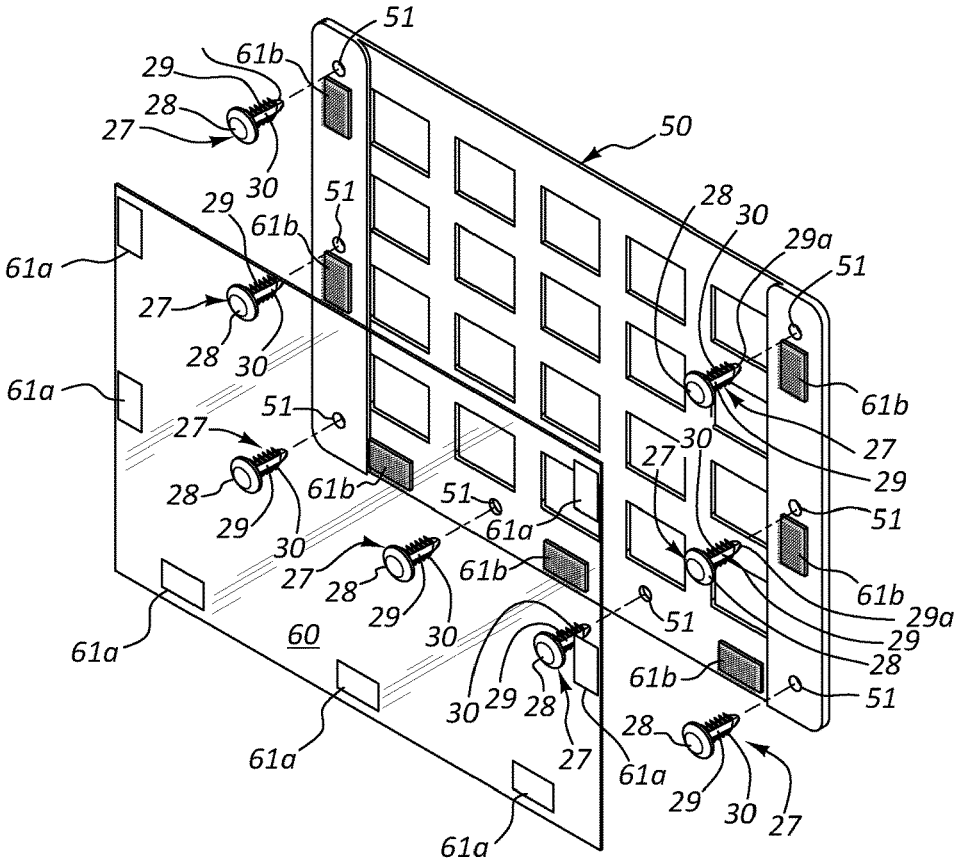
FIG. 9 shows another embodiment of an elastic net that is a single unit formed from an elastic material with spaced openings and as including spaced holes formed around three sides to receive push to lock fasteners fitted therethough, and shows a splash guard aligned for fitting over the elastic net with sections of hook and mat couplings secured to the opposing surfaces of the elastic net and splash guard, respectively.

Further to the assembly of the rectangular elastic net 21, as shown in FIG. 2, the elastic cloth straps 22 receive a support border 24 fitted thereover that has a U shape, and is formed from straight sections of flexible cloth straps 25 that are secured at their corners to one another at right angles, and the border support 24 is fitted to three sides of the elastic net 21, to cover over the elastic cloth straps 22 ends, and is secured thereto as by sewing, or with an adhesive, maintaining the support border 24 around three of the four elastic net 21 side. Shown in FIGS. 1 and 2, 4 and 5, 7 and 8, the elastic net 21 is thereby left open on the side away from the lid hinge 13. With, in FIGS. 9 through 11, the elastic net 50 is shown as a single unit and has holes 51 formed therethrough at the elastic net corners and at spaced intervals around three sides. Which holes 51 are to receive fasteners 28 as shown in FIG. 9, for coupling the elastic net 50 to the under surface 12*a* of the top 12 of the ice chest 10, so as to leave open the elastic net 50 edge of the ice chest 10 lid 12 that is opposite to the ice chest lid hinges 13, as shown in FIG. 11. So arranged the elastic net 50 edge can be pulled away from the lid 12 undersurface 12*a* so as to allow food items to be fitted therethrough.

Figure 3:
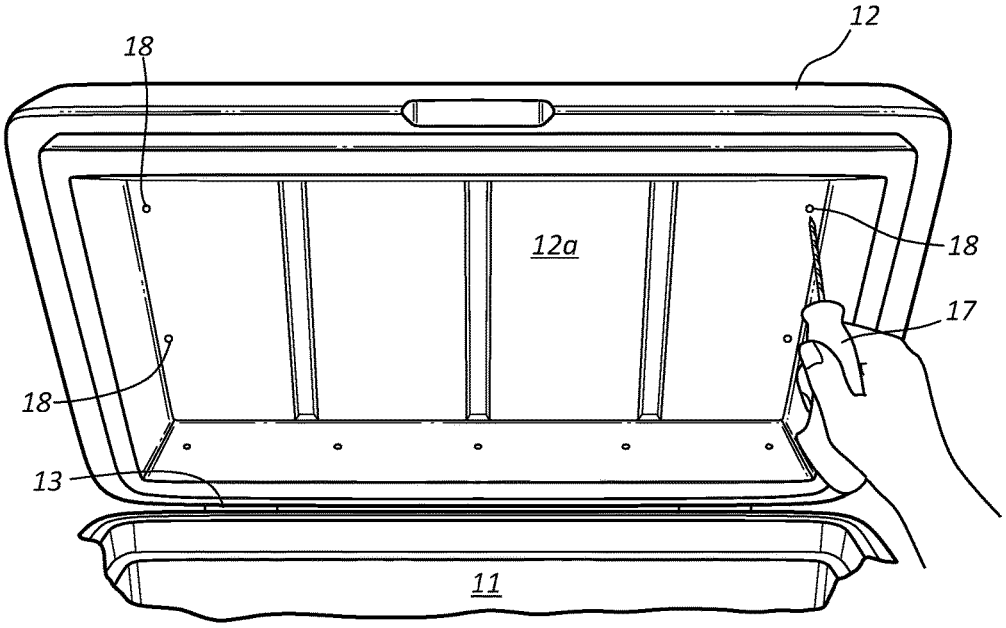
FIG. 3 shows a front elevation section of the chest lid of FIG. 1 and shows an operators' hand turning a hand drill, so as to form spaced holes in the undersurface of the chest lid that are each to receive a press to lock fastener, as shown in FIG. 2.
Figure 4:
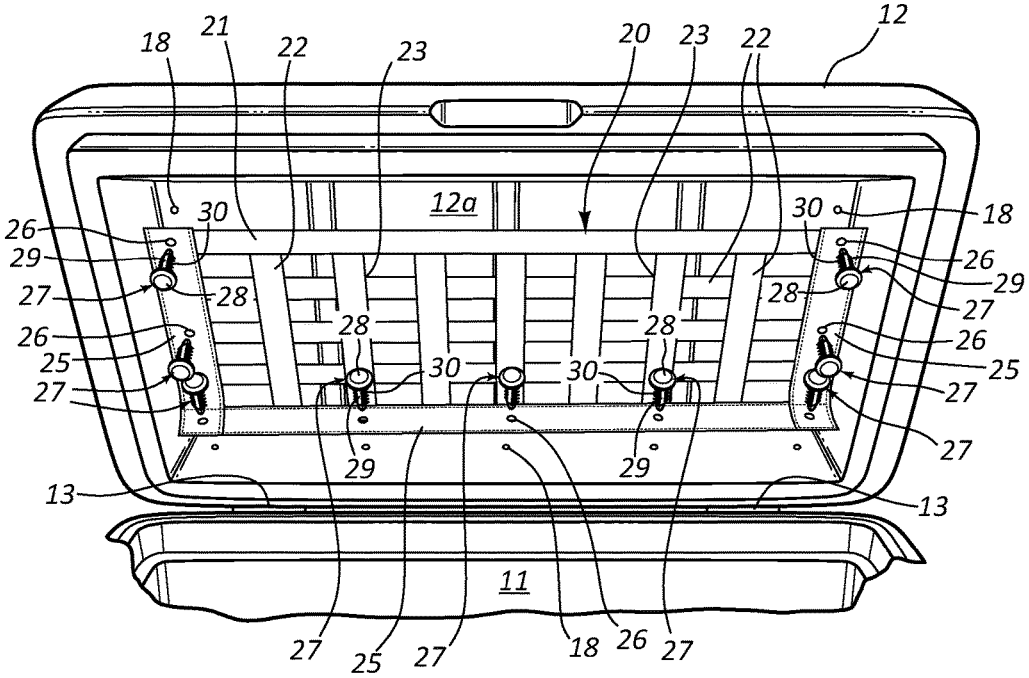
FIG. 4 shows the flexible fabric frame whereto is connected the elastic strap net that has space holes formed therethrough that are aligned with the holes formed in the chest lid of FIG. 3, and shows the press to lock fasteners of FIGS. 2 and 3 aligned for fitting through which aligned flexible fabric frame and lid holes.

Shown in FIGS. 2, 3 and 4, the net 21, attached to the support border 24, forms the food item support 20, when the support border 24 is mounted to the chest cooler 10 lid undersurface 12*a*. Shown in FIG. 3, to receive the food item support 20, the lid 12 inner surface 12*a* has holes 18 formed, as with a hand drill 17, or other tool, into the lid inner surface 12*a* that will align with holes 26 that are formed through the support border 24, as shown in FIG. 2, and holes 51 that are formed through the elastic net 50, respectively.

Figure 5:
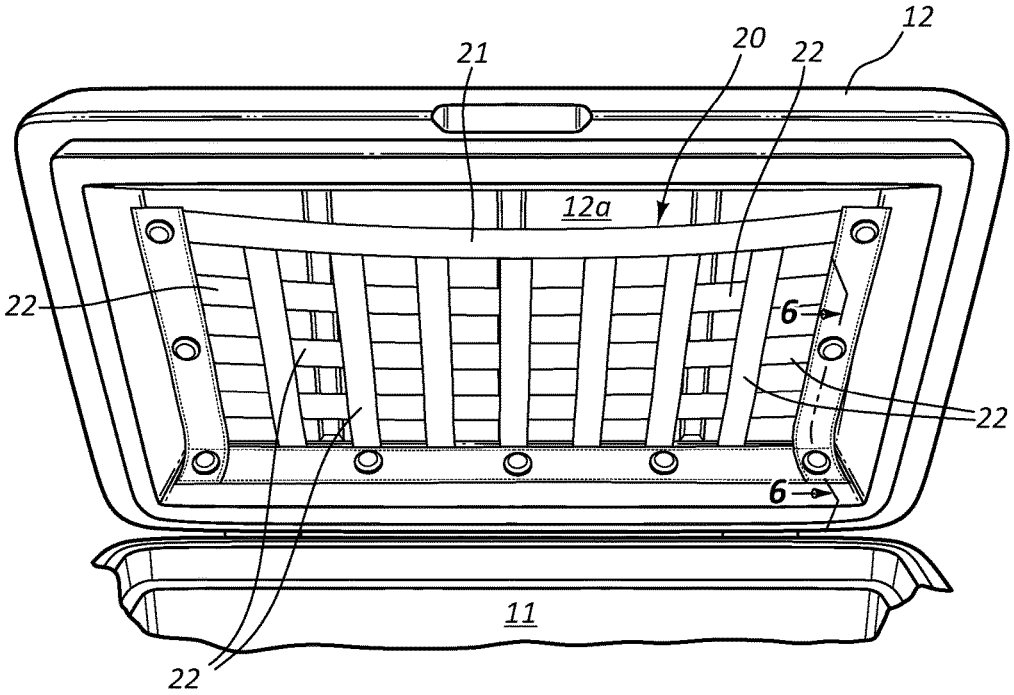
FIG. 5 shows the flexible fabric frame and elastic strap net of the invention fitted to the undersurface of the chest lid, with the open elastic net side positioned so as to be adjacent to the chest lid latch edge.
Figure 6:
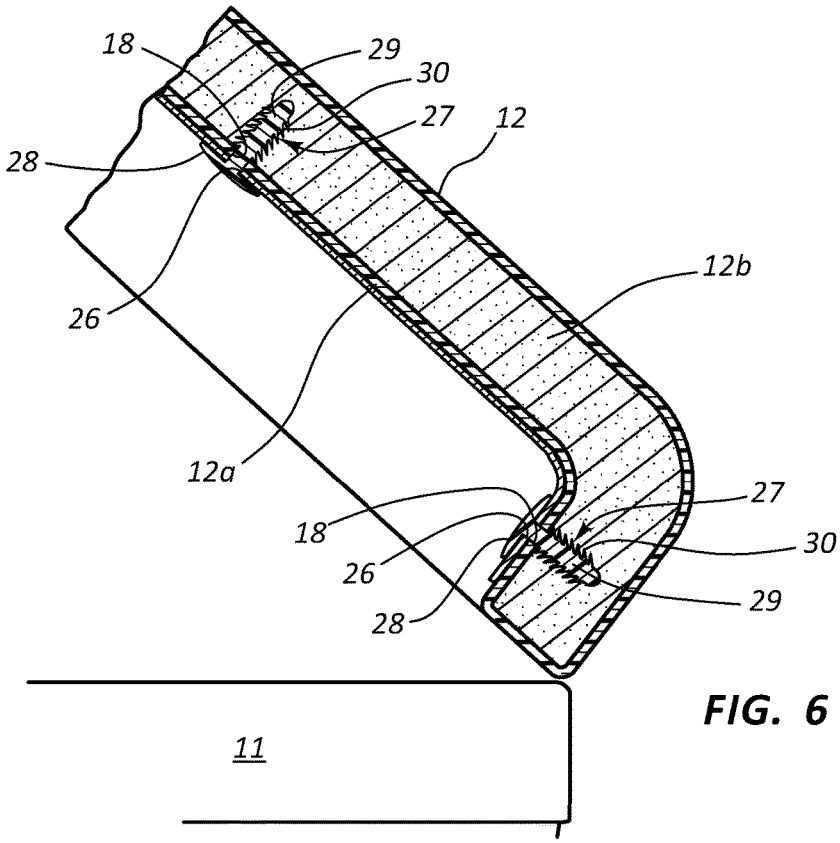
FIG. 6 is a sectional view taken along the line 6-6 of FIG. 5 of the chest lid, showing an end section of the chest lid as being filled with insulation, and showing push to lock fasteners, as having flexible teeth that slope towards their head end, to hold the fasteners in the lid interior without damage thereto.

To install the food item support 20 and elastic net 50 to the lid under surface 12*a*, as shown in FIGS. 4, 5, and 11, the holes 18 and 51 are formed in the lid 12*a* undersurface and so as to receive locking fasteners 27 press fitted through the respective holes 18 and 51, that travel into the space between the top of the lid 12 and lid undersurface 12*a*, that, as shown in FIGS. 6, through and 8 and 11, that may be filled with an insulation material 12*b*, but, within the scope of this invention, may be an open space.

The locking fasteners 27, as shown best in FIGS. 6 and 9, preferably each include a broad head 28 and shaft 29 with threads 30 formed there around, and, preferably, the shaft 29 has a pointed end 29*a*. Which individual threads 30 each preferably slope towards the head 28 and are formed from a flexible material, such as a plastic, to bend when passed through a hold 18 or 51 and will flex back to their original attitude, within the ice chest lid 12, when they have individually passed through holes 18 or 51. So arranged, to install the locking fasteners 27 through the lid undersurface holes 18, an operator pushes, as with their thumb or finger on the head 28, urging the shaft 29 through the aligned support border holes 26, as shown in FIG. 4, and lid undersurface holes 18, and into the insulation material 12*b*, or into a void, with the locking fastener 27 threads 30 then flexing inwardly towards the shaft 29, as they pass through the lid undersurface 12*a* holes 18, and which threads 30 then flex outwardly, within the insulation material 12*b*, or void, whereby the threads outer ends will extends across the lid undersurface holes 18 edges, prohibiting withdrawal, and locking the food item support 20 support border 24 or elastic net 50 to the lid 12 undersurface 12*a*, as shown in FIGS. 1,5, 7, 8 and 11.

While the locking fasteners 27, as set out above, are preferred for securely fastening the food item support 20 support boarder 24 and elastic net 50 onto the lid 12 undersurface 12*a*, it should be understood that other fasteners having like capabilities could be so used within the scope of this disclosure. With the food item support 20 and elastic net 50 in place, food items 16, as shown in FIGS. 1. 7 and 8, can be passed through the opening between the lid 12 undersurface 12*a* and rectangular flexible net 21 top elastic strap 22 and elastic net 50 edge that flex outwardly, holding the food items 16 safely in place above the level of ice and water 14, as shown in FIG. 8, during movement of the ice chest 10.

Figure 10:
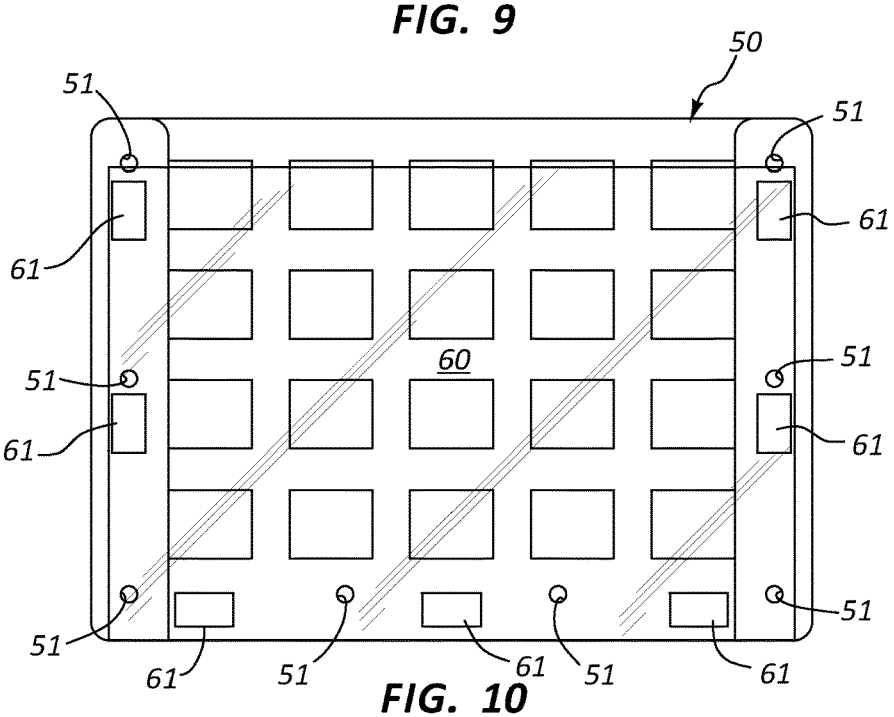
FIG. 10 shows the splash guard and elastic net of FIG. 9 coupled together.
Figure 11:
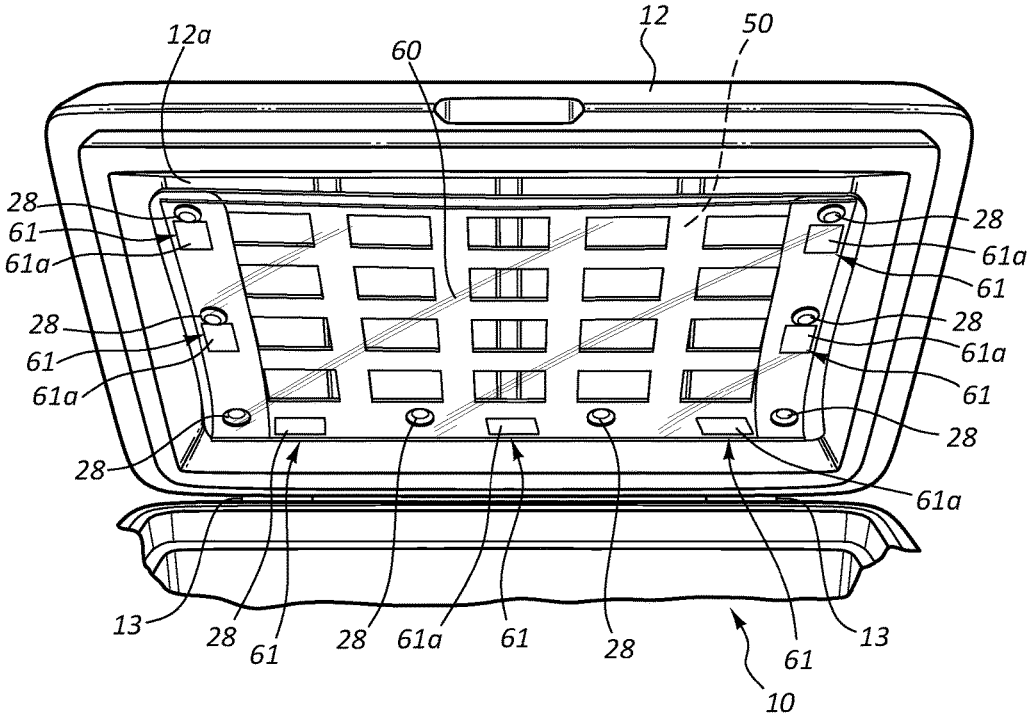
FIG. 11 shows the elastic net with the splash fitted thereto mounted to the lid of an ice chest.

Additionally, both the food item support 20 and elastic net 50, shown in FIGS. 9 through 11, can include a splash guard 60, shown in FIGS. 9 through 11, for fitting across the elastic net 50, and extending beyond the edges thereof. Which splash guard 60 is arranged for releasable attachment to the elastic net 50 to cover thereover and is mounted at spaced releasable attachment points to the lid 12*a* undersurface to prohibit water from splashing from the water and ice mixture in the chest cooler into the food item support 20 and elastic net 50 as that could contaminate the food items maintained therein. To maintain the splash guard 60 mounted over the flexible net 50, as shown in FIG. 11, releasable fasteners 61 are provided that allow for a convenient mounting and removal of the splash guard 60 from the covering arrangement of FIG. 11. Which releasable fasteners 61 are shown in FIG. 9 as like rectangular sections of hooks 61*a* and matts 61*b*, respectively, that each have an adhesive backing that, when pressed against the respective opposing surfaces of the elastic net 50 and splash guard 60 will adhere thereto and, when pressed together, will releasably connect. In practice, hook and mat sections of a Velcro® have been used to perform this connection of the splash guard 60 over the elastic net. Which matts 61*a* and 61*b*, shown in FIGS. 9 through 11, are spaced apart to provide openings therebetween that water as may splash into the elastic net 50, should the ice chest be tipped, for example, to drain therefrom when the ice chest is righted. In practice, the splash guard 60 is preferably formed from a section of a clear plastic material that will flex when bent to accommodate movement of the elastic net 50, and will allow a person opening the ice chest 10 to view the food items maintained in which elastic net 50.

Hereinabove has been set out a description of a preferred embodiment of the chest cooler accessory of the invention. It should however, be understood that the present invention can be varied within the scope of this disclosure without departing from the subject matter coming within the scope of the following claims, and a reasonable equivalency thereof, which claims I regard as my invention.

I claim:

1. A chest cooler accessory for maintaining food items above a level of ice and water in the chest cooler comprising, a rectangular elastic net for attachment to a chest cooler lid undersurface that is hinge connected along one edge to said chest cooler; means for attachment of said rectangular elastic net around three sides to an undersurface of said chest cooler lid such that an unattached side of said rectangular elastic net is open along its edge that is opposite to a lid hinge connection to said chest cooler; a rectangular splash guard formed from a clear flexible material to fit over said elastic net so as to extend to said elastic net edges; and means for releasably securing said splash guard, at spaced intervals, around said three sides of said elastic net.

2. The chest cooler accessory as recited in claim 1, wherein the rectangular elastic net is formed from elastic straps that are positioned to cross one another forming essentially right angles with one another, and the junctions of which said elastic straps are secured together.

3. The chest cooler accessory as recited in claim 2, further including a support border that is formed from three sections of flexible straps that are secured together at their ends, at right angles, forming a U shape to fit over said three sides of the rectangular elastic net.

4. The chest cooler accessory as recited in claim 1, wherein the rectangular elastic net is formed as a single unit from an elastic material.

5. The chest cooler accessory as recited in claim 1, wherein the means for releasably securing the rectangular splash guard over the rectangular elastic net are separate sections of hooks and mats that each have an adhesive backing for individual mounting, at spaced intervals, to said elastic net and splash guard three opposing sides that, when pressed together, will couple to hold said splash guard on said elastic net.

6. The chest cooler accessory as recited in claim 1, wherein the means for securing the rectangular elastic net to the lid undersurface are push to lock fasteners that each have a broad head end to be engaged by an operator's thumb or finger, have a shaft extending at a right angle from said broad head undersurface that includes a pointed end and have spaced teeth formed there along that each slope towards said head end undersurface, and which said push to lock fasteners are formed from a flexible plastic material to fit through spaced aligned holes formed through the rectangular elastic net and the lid undersurface, traveling into a space between said lid and the lid undersurface and the said has spaced flexing teeth formed there along that each slope towards said head end undersurface and, when each said lock fastener is pushed by an operator through holes formed through elastic net and the lid undersurface, into the space within the ice chest lid, said flexing teeth will bend opposite to the pushing force exerted by the operator, and will spring back to their original attitude within said ice chest lid space.

* * * * *